US006345758B2

(12) United States Patent
Jäggi

(10) Patent No.: US 6,345,758 B2
(45) Date of Patent: Feb. 12, 2002

(54) BOX WITH A COVER AND A FRONTAL FLAP FORMED IN A SINGLE BLANK WITHOUT ADHESIVE BONDING

(75) Inventor: Felix Jäggi, Bienne (CH)

(73) Assignee: The Swatch Group Management Services AG, Biel (CH)

( * ) Notice: Subject to any disclaimer, the term of this patent is extended or adjusted under 35 U.S.C. 154(b) by 0 days.

(21) Appl. No.: 09/892,535

(22) Filed: Jun. 28, 2001

(30) Foreign Application Priority Data

Jul. 3, 2000 (EP) ..... 00202305

(51) Int. Cl.[7] ..... B65D 5/22

(52) U.S. Cl. ..... 229/123; 229/145; 229/173; 229/177; 229/178

(58) Field of Search ..... 229/122, 123, 229/145, 173, 177, 178

(56) References Cited

U.S. PATENT DOCUMENTS

| | | | | |
|---|---|---|---|---|
| 2,464,904 A | * | 3/1949 | Tomarin | 229/123 |
| 2,768,777 A | | 10/1956 | Barrington et al. | |
| 2,839,236 A | | 6/1958 | Dunning | |
| 3,112,058 A | * | 11/1963 | Martin | 229/122 |
| 3,834,526 A | * | 9/1974 | Zine, Jr. | 229/123 |
| 4,240,576 A | * | 12/1980 | Persson | 229/145 |
| 4,245,771 A | * | 1/1981 | Christian | 229/178 |
| 4,511,079 A | * | 4/1985 | Lopez | 229/178 |
| 5,145,109 A | * | 9/1992 | Faulstick | 229/145 |

FOREIGN PATENT DOCUMENTS

| | | |
|---|---|---|
| DE | 819 495 | 10/1951 |
| FR | 2 440 880 | 6/1980 |
| FR | 2 696 154 | 4/1994 |
| FR | 2 700 518 | 7/1994 |
| GB | 2 281 065 | 2/1995 |

* cited by examiner

*Primary Examiner*—Gary E. Elkins
(74) *Attorney, Agent, or Firm*—Griffin & Szipl, P.C.

(57) ABSTRACT

The cut blank includes a rectangular bottom F having its sides extended by four sets of panels and flaps respectively forming a back panel (11) and a wrapping cover (1) with a double front panel (13, 14), a frontal flap (2), a first small side with a double wall (31, 32), and a second small side with a double wall (41, 42) extended by a double bottom (43) snapping into a wall (32) of the first small side. Flaps articulated on the back panel (11) and caught between the double walls (31, 32; 41, 42) of the small sides are extended by snugs (**8*a*, 8*b*) which engage in notches (9*a*, 9*b*) of a front panel (14) of the cover (1**) to lock the box in a completely closed position.

5 Claims, 1 Drawing Sheet

BOX WITH A COVER AND A FRONTAL FLAP FORMED IN A SINGLE BLANK WITHOUT ADHESIVE BONDING

The present invention concerns a parallelepiped box having a cover articulated on one edge and a complementary frontal flap articulated on the edge diametrically opposite to the articulation edge of the cover, said box being formed by cutting and folding a single blank without adhesive bonding.

The invention concerns more particularly such a box cut into a blank made of flexible plastic material, which is embossed or corrugated, along a contour which, in a completely closed position, has no assembly slot communicating with the exterior and locks the cover in a closed position by a blocking notch making other means for blocking the cover unnecessary (for example scotch tape, elastic tape, snap fasteners, Velcro, etc . . . ). In the open position, the contour limits the pivoting of the frontal flap while allowing stacked flat objects to be easily picked up from the bottom, such as buckets pallets able to contain an assortment of products.

Numerous ways of cutting a blank have already been proposed to form boxes which can be stored flat and assembled by folding when required. U.S. Pat. No. 4,066,205 discloses a box with a folding front panel but the assembly of which requires adhesive bonding. French Patent No. 2 573 037 discloses an archive box able to be assembled without adhesive bonding and including a folding front panel and a cover articulated by means of lugs engaged in slots in the flaps of the small sides. This box thus has several through passages which place the interior of the box in communication with the exterior. The box disclosed in European Patent No. 0 411 279 includes a pivoting panel and a cover articulated perpendicular to the pivoting axis and including numerous cut out portions which make the interior of the box communicate with the exterior. This box is theoretically able to be assembled without adhesive bonding, but experience has shown that the small flap of the double bottom is insufficient for the box to be strong after assembly.

The object of the present invention is thus to overcome the drawbacks of this prior art by providing a box with a cover and a front flap assembled without adhesive bonding from a single blank, with no through passage communicating with the exterior and strong after assembly.

The cut blank therefore includes a rectangular bottom F with its sides extended by four sets of panels and flaps forming respectively a back panel and a wrapping over with a double front panel, a front flap, a first small side with a double wall and a econd small side with a double wall extended by a double bottom which snaps into a all of the first small side. Flaps articulated on the back panel and caught between the double walls of the small sides are extended by snugs which engage in the notches of a front panel of the cover to lock the box in the completely closed position.

Other features and advantages of the present invention will appear in the following description of an embodiment example, with reference to the annexed drawings, in which.

Figure 1:
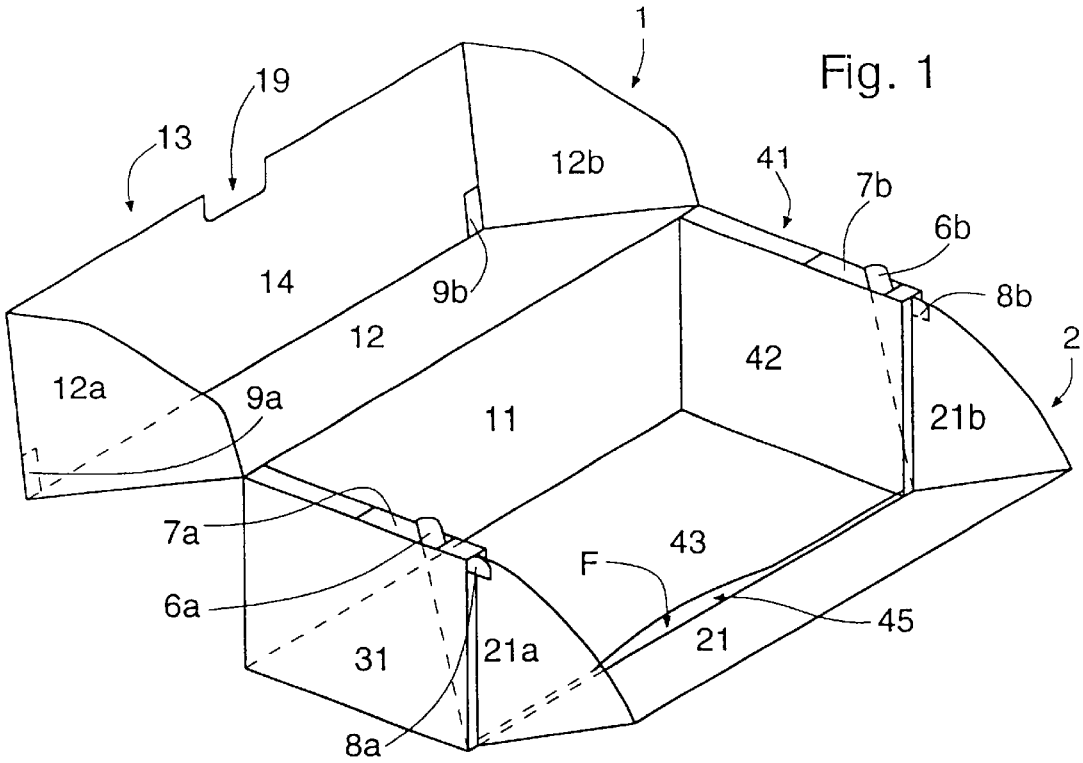
FIG. 1 is a perspective view of the box in the completely open position.

The parallelepiped box shown in perspective in the open position in FIG. 1 includes a cover 1 and a frontal flap 2 which pivots about an edge of the bottom F, while its travel is limited by two snugs 6*a*, 6*b* which slide in slots 7*a*, 7*b* formed on the top part of small sides 31, 32; 41, 42. It can also be seen that there are two small snugs 8*a*, 8*b* on the top part of small sides 31, 32; 41, 42, which extend a little beyond flap 2 when the latter is in the closed position. When flap 2 is closed and one folds down cover 1, snugs 8*a*, 8*b* snap into cuts 9*a*, 9*b* arranged in a double layer wall of cover 1. This perspective diagram also shows that bottom F is formed by two layers one of which includes a cut out portion 45 allowing flat stacked objects to be picked up more easily from the bottom.

Figure 2:
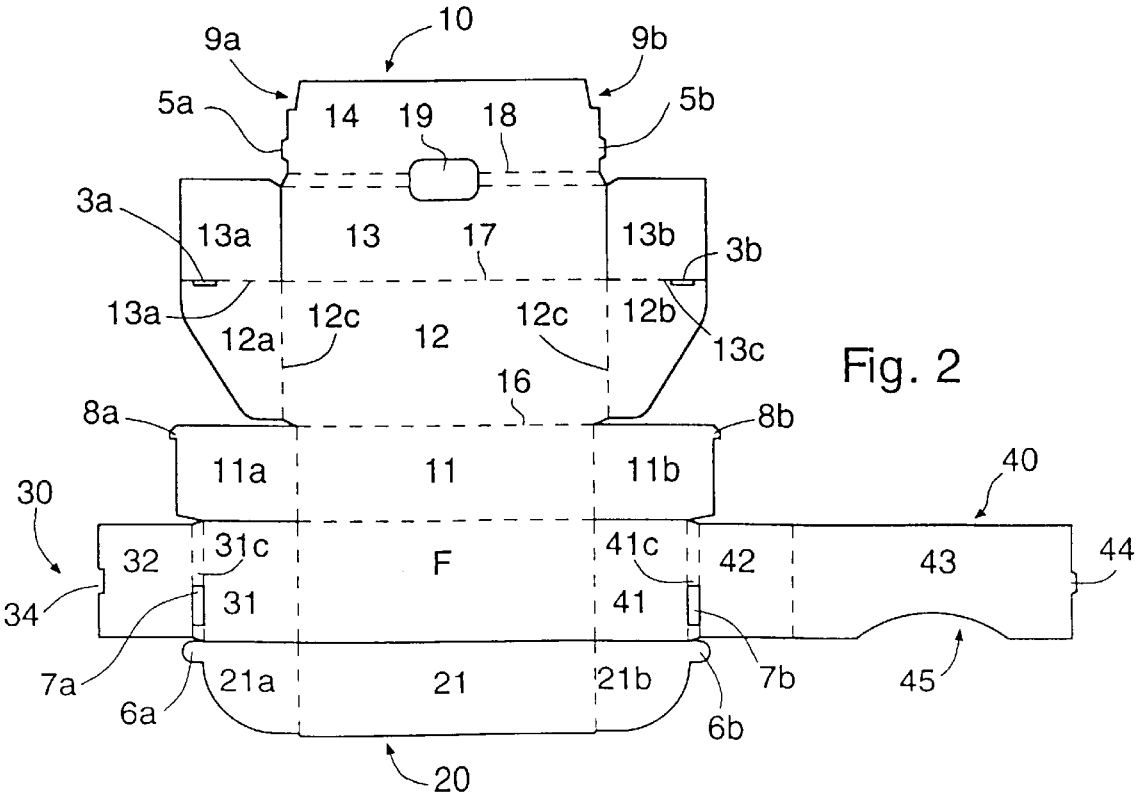
FIG. 2 is a diagram showing how the flat blank is cut to obtain the box shown in FIG. 1.

Reference will now be made more particularly to FIG. 2 which shows a cut blank which will allow the box shown in FIG. 1 to be made by folding along the dotted lines. As can be seen, the four sides of bottom F are extended by four sets 10, 20, 30, 40 of assembly panels and flaps.

The first set 10 in the extension of a large side of F includes ten elements, panels and flaps, the functions of which in fact correspond to two sub-sets to form back panel 11 and cover 1. The first set 10 includes thus rear panel 11, extended by two lateral extensions formed of two flaps 11*a*, 11*b* having the length of a small side F and each including a snug 8*a*, 8*b* at the corner opposite the meeting point with bottom F.

The second sub-set, connected to the first by a fold line 16 thus includes a panel 12 forming the top part of cover 1, said panel 12 being extended on its small sides by two lugs each formed of a panel 12*a*, 12*b* extended, on the side adjacent to fold line 12*c* with panel 12, by a flap 13*a*, 13*b* which has the width of the depth of the box. The fold line 13*c* between panels 12*a*, 12*b* and flaps 13*a*, 13*b* includes, close to its most outer part, a slot 3*a*, 3*b*. Finally, the large side of panel 12 includes a double fold 17 extended by two panels 13, 14 each having substantially the width of the depth of the box. The end panel 14 is provided with snugs 5*a*, 5*b* on its small sides and flat cuts 9*a*, 9*b* in its corners. The fold 18 between panels 13 and 14 includes an oblong opening 19 this second sub-set will allow the cover to be made by folding flaps 13*a*, 13*b*, then panels 12*a*, 12*b*, then folding down panels 13, 14 on either side of flaps 13*a*, 13*b* so that the snugs snap into slots 3*a*, 3*b*.

The second set 20 constitutes the frontal flap articulated by a fold on the other large side of bottom F. It includes a panel 21 which has the width of the depth of the box and includes on each of its two small sides a lateral flap 21*a*, 21*b* in the shape of a quadrant the free side of which is extended by a stop 6*a*, 6*b*.

The third 30 and fourth 40 sets are in the extension of the small sides of bottom F. The third set 30 includes two panels 31, 32 which have the width of the depth of the box and a slot 7*a* between their double fold line 31*c*. The last panel 32 includes a notch 34 in its outer part. The fourth set 40 likewise includes two panels 41, 42 having a slot 7*b* between their double fold line 41*c*. Panel 42 is extended by a panel 43 having 9*a* the dimensions of bottom F and including a snug 44 at its end.

In order to finish the construction, flaps 11*a*, 11*b* are folded down and panel 11 is folded, then pivoting flaps 21*a*, 21 are folded down and panel 21 is folded so as to apply pivoting flaps 21*a*, 21*b* onto the inner faces of flaps 11*a*, 11*b*. Then, panels 31, 32 are folded down on either side of flaps 11*a*, 21*a*, and likewise panels 41, 42 are folded down on either side of flaps 11*b*, 21*b* and finally the end panel 43 is pressed? so as to snap snug 44 into notch 34. As can be seen, owing to the double bottom formed by panel 43 and owing to the double layer at notch 34, it is not necessary to have a through passage near the bottom, which provides the box with better sealing, for example against dust. Advantageously, a material having a certain thickness and a certain flexibility will be chosen for the blank such as a sheet of embossed or corrugated polypropylene.

Once the box is thus assembled, it can be seen with reference to FIG. 1, that the front folding flap can tip forward, its travel being limited by stops 6*a*, 6*b* which slide in slots 7*a*, 7*b*. It can also be seen that, when the folding flap is completely closed, snugs 8*a*, 8*b* slightly project so that by folding down cover 1 they snap into flat cuts 9*a*, 9*b* locking the cover for example for transport without it being necessary to add other means for locking the cover. The box which has just been described thus has the advantage of being able to be assembled easily without adhesive bonding, having a good level of rigidity and sealing close to that of boxes made by adhesive bonding. Without departing from the scope of the invention, those skilled in the art can adapt the construction which has just been described, for example by providing more than one snug 44 for securing the bottom.

What is claimed is:

1. A box with a complementary cover and frontal flap made by cutting and folding a single blank without adhesive bonding including a rectangular bottom F the sides of which are extended by four sets of panels and flaps connected to each other by folds, wherein:

a first set in the extension of a large side of F includes ten panels and flaps corresponding to two sub-sets having respectively a panel to form the back wall extended by a panel to form the top of the cover, said back panel having two lateral extensions formed by two flaps having the length of a small side of F and each including a snug in the corner opposite the corner of junction with F, and said panel of the cover being extended on the one hand on its small sides by two small lugs each formed of a panel extended, on its side adjacent to the fold line with the cover panel, by a flap which has the width of the depth of the box and whose fold line is provided with a slot, on the other hand on its large side by two panels having substantially the width of the depth of the box, the end panel being provided with snugs on its small sides and flat cuts in the outer corners, said end panel being folded to cover the other panel pinching the flaps such that the snugs engage in slots.

a second set forming the frontal flap in the extension of the other large side of F, formed of a panel which has the width of the depth of the box and includes pivoting lateral flaps in the shape of a quadrant the free side of which is extended by a stop, a third set and a fourth set in the extension of the small sides of bottom F each including two panels intended to be folded on the flaps of the first set and on the pivoting flaps of the second set to form the sides of the box, the double fold lines of said panels each being provided with a slot intended to co-operate with the stops of the second set to limit the travel of the frontal flap, the distal side of the end panel of the third set including at least one notch and the corresponding panel of the fourth set being extended by an end panel of the same length as F and the distal side of which is provided with a snug intended to engage in the notch of the first set to lock the back panel and the side panels by forming a double bottom.

2. A box with a cover and frontal flap according to claim 1, wherein the snugs of the flaps articulated on the back panel co-operate with the flat cuts of the inner panel of the cover to lock said cover by snapping.

3. A box with a cover and a frontal flap according to claim 1, wherein the double bottom further includes a cut out portion on the side of the frontal flap to facilitate the picking up of products contained in said box.

4. A box with a cover and a frontal flap according to claim 1, wherein the double fold line between the two panels forming the front part of the cover include an oblong opening allowing, once the two panels have been folded down on top of each other, a notch to be formed facilitating handling of the cover.

5. A box with a cover and a frontal flap according to claim 1, wherein the blank is cut in a sheet made of embossed polypropylene.

* * * * *